United States Patent [19]

Tedeschi

[11] Patent Number: 5,031,682

[45] Date of Patent: Jul. 16, 1991

[54] DEVICE FOR ADJUSTABLE PRE-LOADING OF ELASTIC MEANS ASSOCIATED WITH A TAKE-UP ROLLER

[75] Inventor: Giovanni Tedeschi, Funo Di Argelato, Italy

[73] Assignee: Sunproject S.R.L., Cadriano-Granarolo Emilia, Italy

[21] Appl. No.: 520,092

[22] Filed: May 7, 1990

[30] Foreign Application Priority Data

May 12, 1989 [IT] Italy ..... 4809/89[U]

[51] Int. Cl.[5] ..... A47H 1/00

[52] U.S. Cl. ..... 160/315; 160/323.1; 160/903

[58] Field of Search ..... 160/315, 313, 314, 323.1, 160/326, 306, 903; 242/107.5; 248/251, 266, 268

[56] References Cited

U.S. PATENT DOCUMENTS 1,726,589 9/1929 Schultes ..... 160/315
1,934,103 11/1933 Traut ..... 160/315 X
2,520,618 8/1950 Winter ..... 160/315
2,696,249 12/1954 Prokop et al. ..... 160/315 X
2,696,250 12/1954 Michelman ..... 160/315

*Primary Examiner*—David M. Purol
*Attorney, Agent, or Firm*—Darby & Darby

[57] ABSTRACT

A plate for closing one end of a box for housing a window shade roller, includes a cylindrical recess made in the plate coaxially to a through hole and into which a bushing is placed. The bushing is provided with an axial hole having a polygonal cross section and two strikers suited to fit into corresponding notches in the recess. A spring placed inside the recess on a collar integral with the bushing, locks the strikers and notches and prevents axial rotation of the bushing. A washer fastened to the plate closes the recess. A non-round tang extending from one end of a roller can engage the hole in the bushing. Axially pushing on the bushing while rotating the bushing achieves the release of the strikers from the notches, and allows adjusting of the loading of the window shade roller by rotating the tang.

6 Claims, 2 Drawing Sheets

Fig.1
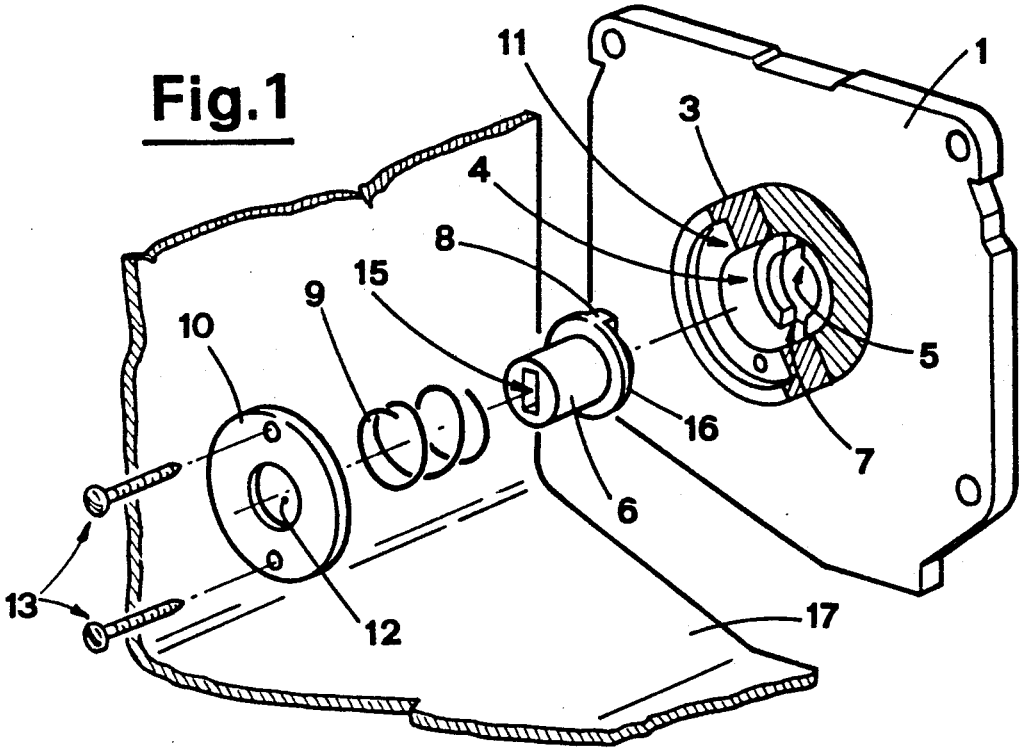
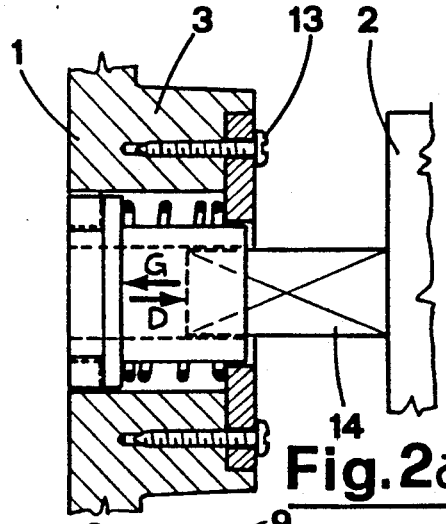
Fig.2a
Fig.2b
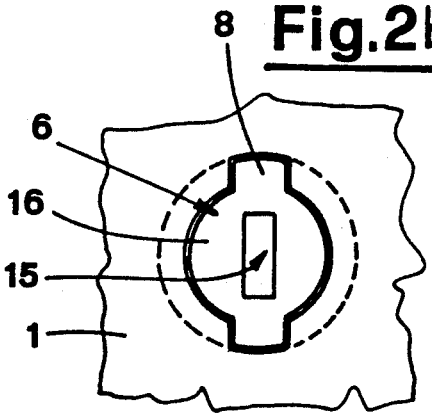
Fig.3b
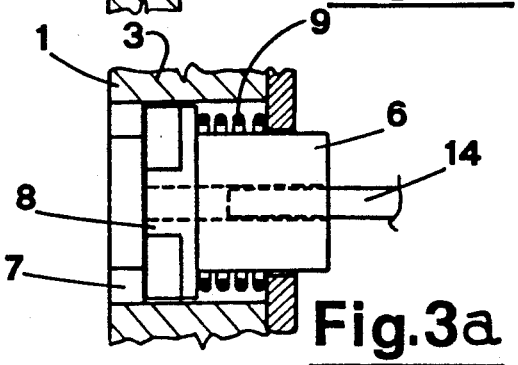
Fig.3a
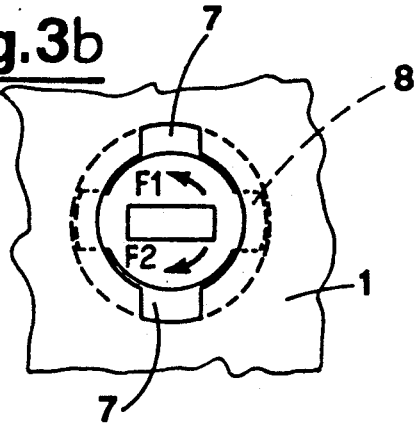

DEVICE FOR ADJUSTABLE PRE-LOADING OF ELASTIC MEANS ASSOCIATED WITH A TAKE-UP ROLLER

BACKGROUND OF THE INVENTION

This invention is within the framework of the technical field concerning the production of accessories for systems having a light-dimming function, to be applied to windows, such as, for instance, the well known vertically-movable window shades.

DESCRIPTION OF THE PRIOR ART

Many kinds of systems are known, which can be fitted to windows, comprising a window shade which can be moved vertically to vary the surface of the window covered by the blind cloth or by the strips or any other matter of which the system consists.

Said window shades or curtains are generally rolled up on a roller supported horizontally inside a suitable housing, commonly called a box, which is placed over the window, or close to the upper edge of the window frame. The roller can rotate axially and it is subject to the action of elastic means, placed inside itself, which are fastened to a port fixed with respect to the roller. By unrolling the curtain, the elastic means are loaded.

Other locking means provide for the steady positioning of the curtain in the desired position, thus locking the roller.

Once the locking means have been released, the elastic means inside the roller cause the roller to rotate, thus to rewind the curtain.

Obviously, for the correct operation of said device, a preliminary loading of the elastic means inside the roller is generally required.

Since the part fixed, with respect to the roller, to which part the elastic means inside the roller are fastened, must be connected in its turn with a fixed structure, i.e. the rolling blind box in particular, it is clear that the preliminary loading of the elastic means can be carried out only after assembly of the accessory, in general, has been completed.

In particular, there are known devices which are positioned close to a head of the roller and supported by the closing plate of the box head, and suited to allow the preliminary loading of the elastic means acting on the roller, as well as the subsequent adjustment of their preliminary loading.

Said known devices require a semicircular groove to be made in the surface of the outer plate, with respect to the roller, and also two holes close to the ends of the groove.

Two pins, connected with each other by a semicircular metal segment, are inserted into the holes of the plate, to be subsequently inserted into corresponding holes made in a bushing, with which the fixed part, holding the elastic means inside the roller, is integral, or in any case mechanically connected.

To carry out the preliminary loading, it is necessary to lift the semicircular segment from the relative seating, i.e. the semicircular groove, remove both pins from the holes, operate by means of a suitable tool (screwdriver) and through a hole, made for that purpose in the plate, on the bushing, causing it to rotate in either direction so as to obtain the desired stretching of the elastic means, and finally insert the pins back again into the associated holes.

Obviously, such a device is not very functional, and the operation to carry out the preliminary loading is quite complex.

Furthermore, when the preliminary loading is to be adjusted in subsequent phases, the problems arising for the operator are obvious. He should keep the bushing, with just one hand and using a special tool, in the previously determined position, and he should remove both pins from the associated holes at the same time. Then, he should move the bushing, and rotate it in either direction, to increase or reduce the tension of the elastic means respectively, while paying attention to avoid releasing the bushing. This would otherwise release the elastic means which would return to the unloaded position, so creating the need to start the operation again from the beginning.

SUMMARY OF THE INVENTION

The object of this invention is to present a device, for carrying out the adjustable preliminary loading of the means associated with a take-up roller, which operates quickly and easily, and avoids the risk of compromising the adjustment made previously every time it is desired to adjust the tension of the elastic means inside the roller.

Said object is achieved, according to this invention, through a device for the adjustable preliminary loading of the elastic means associated with a take-up roller for curtains. The device, which is associated with a plate closing one head of a box containing said roller, being characterized in that said plate includes a cylindrical recess made coaxial to a through hole in said plate. Inside said recess is placed a bushing having an axial hole with polygonal section and having two strikers integral with one of its heads suited to fit into corresponding notches, through the effect of the action of elastic means also placed inside said recess and operating in an opposite direction as to said roller, on a collar integral with said bushing, with said notches made along the lip of said through hole, so to achieve the stopping of the axial rotation of said bushing. Also provided is a washer fastened to said plate to close said recess, with the inner head of said bushing passing through the hole of the same washer, with the possibility for said bushing to be pushed axially in a direction towards said roller, to cause said strikers to be released from said notches, with the possibility of axial rotation for said bushing according to opposed directions.

BRIEF DESCRIPTION OF THE DRAWINGS

The features of this invention are pointed out below, with a particular reference to the enclosed drawings, where:

FIG. 1 shows an exploded view of the device being the subject of this invention;

FIGS. 2*a* and 2*b* partially show the device in question in a first position, respectively cutaway and viewed from one of its outer sides;

FIGS. 3*a* and 3*b* partially show the device in question in a second position, respectively cutaway and viewed from one of its outer sides.

DESCRIPTION OF THE PREFERRED EMBODIMENT

Figure 4:
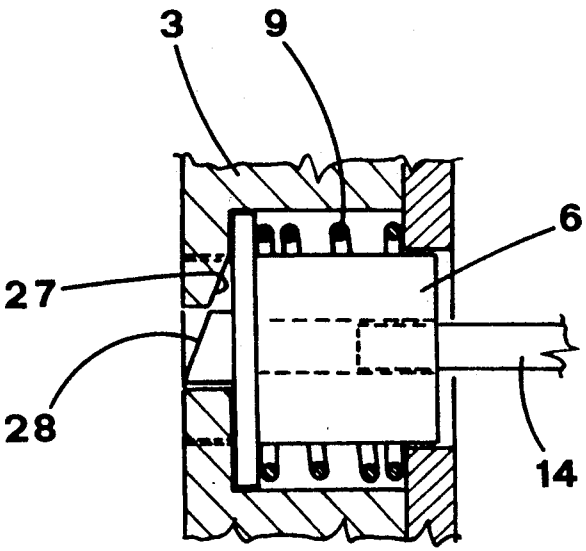
FIG. 4 is a partial view of an alternative embodiment in accordance with the invention.

With reference to the above-mentioned figures, no. 1 indicates the closing plate of the housing 17 (commonly called rolling blind box) inside the housing is an assembly made up a roller 2, of the fixed part to which the elastic means acting on the roller are fastened, and the curtain wound on the roller.

The fixed part, the elastic means acting on the roller, and the curtain wound on the same roller, are not illustrated since they are well known. A small section of the curtain protrudes from the box so as to be pulled and unwound from the roller.

The plate 1 in almost a central position, includes a protrusion or boss 3, e.g. of cylindrical shape, integral with the plate itself. The protrusion 3 or boss originates from the surface of the plate inside the box and is directed towards the roller 2. The protrusim 3 is also provided with an axial hole defining a cylindrical recess 4 coaxial to a through hole 5 made on the plate 1.

Along the lips of the hole 5, two notches 7 are made, in diametrically opposed positions, which are mentioned below.

Inside the recess 4 a bushing 6 is inserted, one of whose heads is bearing two strikers 8 suited to fit complementarily into the notches 7 while the same head of the bushing, corresponding to the strikers, is inserted into the hole 5 until a collar 16, integral with the bushing 6 and having a diameter slightly smaller than the inner diameter of the recess 4, strikes against the lips of the hole 5. Finally, the bushing 6 is crossed by an axial hole 15, having a rectangular (or polygonal) section, which is mentioned below. Around the body of the bushing 6 and inside the recess 4, there are elastic means, which in the example shown is consists of a helical spring 9 placed so to strike against the collar 16. Finally, to close the hole 5, a washer 10 is provided, which fits into a corresponding seating 11 made on the head of the protrusion 3, and the washer 10 is fastened to the protrusion 13 screws 13. The washer then compresses the spring 9 which provides an elastic reaction against the collar 16, pushing it in the direction G (see FIG. 2*a*).

The head of the bush 6 directed towards the roller 2 passes through the hole 12 in the washer 10. The fixed part, to which the elastic means acting on the roller are fastened, is provided with a tang 14 complementarily inserted into the corresponding part of the rectangular hole 15, as it is clearly shown by FIGS. 2*a* and 3*a*. The fixed part (not shown) of the roller 2 may be, for example, a stationary shaft within the roller 2 connected to the tang 14 and cooperating also with a counterbalancing spring (not shown) within the roller 2.

With the unit completely assembled, the preliminary loading of the elastic means (not shown) acting in the roller 2 is carried out by inserting a suitable tool, e.g. a screwdriver, into the rectangular hole 15 of the bush 6, from the outer side of the plate 1, and acting first axially on the same tool, whose increasing section prevents it from sliding inside the hole itself. This action by the tool causes axial movement of the bushing 6 in the direction D and causes the release of the strikers 8 from the corresponding notches 7 (see FIGS. 3*a* and 3*b*). Then the rotation of the tool according to either direction F1 and F2 brings about an analogous rotation of the bushing 6, thus of the fixed part of the roller 2, whose tang 14 is inserted in the rectangular hole 15.

The elastic means within the roller 2 are preloaded in this way up to the desired tension.

By removing the tool from the rectangular hole of the bushing 6, the spring 9, providing an elastic reaction on the collar 16 of the bushing, causes the strikers 8 to fit again into the notches 7, so that the bushing and the fixed part are prevented from rotating.

Subsequent adjustments may be made by acting again as described above, in a quick and easy way, since by a single tool it is possible to release the fixed part in the roller 2 and make it rotate to adjust the preliminary loading of the elastic means (not shown) in the roller 2.

The release of the bushing, in fact, occurs only after a tool suited to cause bushing rotation has been inserted into the hole 15.

In this connection, as illustrated in FIG. 4 it is possible to make a variation which makes it possible to carry out the preliminary loading or adjustment of the tension of the elastic means acting in the roller 2, not only by means of a single tool, but also by a single movement.

In fact, it is sufficient to change the corresponding edges of the notches 7 and strikers 8 into inclined planes 27, 28 respectively (e.g. by chamfering them), such notches and strikers being placed downstream as to the sense of rotation of the bushing which increases the tension of the spring acting in the roller 2. With such a constructional variation, it is sufficient to insert the tool into the hole 15 and turn the bushing in the direction which causes the tension of the spring acting in the roller 2 to increase. In this way, the mutual action of the inclined planes of notches and strikers automatically causes the release of the latter ones from the first ones, while the spring 9 restores the coupling of notches and strikers at every fractional turn of the bushing corresponding to the number of notches and strikers.

To reduce the tension of the elastic means acting in the roller 2, it shall be necessary, in any case, to act axially on the bushing 6, as described above. It is to be pointed out, besides the extreme simplicity of the preliminary loading or adjustment operations, that the possibility of compromising a previous adjustment is totally avoided, since it is practically impossible, that the bush accidentally slips while the same is being released.

According to a further obvious variation of the device, not shown since it may be easily deduced from the above, the protrusion 3 may be made separately from the plate 1, also being therefore provided with the hole with notches into which the bush strikers are fitting.

The coupling of the separate body 3 with the plate 1 is achieved by inserting one of the ends of the body, having a reduced diameter for a length equal to the thickness of the plate, into a hole made on the plate, and fastening the same body to the plate by known means, e.g. two screws.

It is understood that the above has been described as an example and it should not be considered a limitation, therefore any variations in constructional details are understood as covered by the patent hereby applied for, as described above and as claimed below.

What is claimed is:

1. A device for adjustable loading of the take-up roller of a window shade, a tang of non-circular cross section extending axially from one end of said roller for adjusting roller loading by rotation about the roller's longitudinal axis, comprising:

a plate for supporting said roller horizontally at said one roller end having said extended tang, said plate having an inside surface facing said roller one end, and an outside surface and a hole therethrough, said hole being substantially coaxial with said roller axis when said plate supports said roller with said roller nearer said inside surface;

a boss extending from said plate inside surface, said boss having a cylindrical recess therein, said recess extending coaxially with said plate hole, said recess having a diameter greater than the diameter of said plate hole to form a lip between said hole and said recess, notches being formed in said lip;

a bushing positioned in said recess and subject to rotation about said roller longitudinal axis and to translation in said recess in a coaxial direction, said bushing including an axially extending hole therethrough having a cross section corresponding with the cross section of said tang, and at one axial end of said bushing closest to said plate said bushing including strikers positioned to fit into said notches of said lip;

a spring within said recess, said spring acting on said bushing to urge it toward said plate and to lock said strikers in said notches, said bushing by application of force thereto being subject to axial movement away from said plate against the force of said spring to release said strikers from said notches and permit rotation of said bushing in said recess, removal of said force allowing said spring to return said strikers to said notches;

closing means for retaining said bushing translatably and rotatably within said recess and for retaining said spring within said recess, the non-circular hole in said bushing being accessible for application of said force from the outside surface of said plate through said hole in said plate.

2. A device for adjusting the take-up roller of a window shade as in claim 1, wherein said boss is integral with said plate.

3. A device for adjusting the take-up roller of a window shade as in claim 1, wherein said boss is separable from said plate, said boss including said recess, said lip and notches, and said device for adjusting further comprising means for attaching said boss to said plate.

4. A device for adjusting the take-up roller of a window shade as in claim 1, wherein said closing means is a circular washer removably fastened to said boss, said boss having a seat on its end the farthest from said plate for receiving said washer in said seat.

5. A device for adjustable loading of the take-up roller of a window shade as in claim 1, wherein adjacent edges of said notches and said strikers are chamfered forming two correspondingly inclined planes, rotation of said bushing causing sliding of one inclined plane on the other inclined plane, said sliding causing said bushing to move axially in said recess, said strikers being released from said notches.

6. A device for adjustable loading of the take-up roller of a window shade as in claim 1, and further comprising a rolling blind box for housing said roller, said plate being the closure for one end of said box.

* * * * *